US005127342A

United States Patent [19]

Taylor

[11] Patent Number: 5,127,342

[45] Date of Patent: Jul. 7, 1992

[54] ADJUSTABLE SHELVING

[75] Inventor: William B. Taylor, Senoia, Ga.

[73] Assignee: International Storage Systems, Covington, Ga.

[21] Appl. No.: 614,097

[22] Filed: Nov. 14, 1990

[51] Int. Cl.[5] ..... A47B 9/00

[52] U.S. Cl. ..... 108/144; 211/187

[58] Field of Search ..... 108/144, 111, 110, 106, 108/107; 211/187, 188, 190, 207, 208; 403/106, 107, 110

[56] References Cited

U.S. PATENT DOCUMENTS

| | | | |
|---|---|---|---|
| 3,757,705 | 9/1973 | Maslow | 108/144 |
| 4,595,107 | 6/1986 | Welsch | 108/144 X |
| 4,627,543 | 12/1986 | Nicely | 108/144 X |
| 4,635,563 | 1/1987 | Hand et al. | 108/144 X |
| 4,656,952 | 4/1987 | Schweizer | 108/144 X |
| 4,799,818 | 1/1989 | Sudimak et al. | 108/144 X |
| 4,815,394 | 3/1989 | Ettlinger et al. | 108/144 X |

FOREIGN PATENT DOCUMENTS

| | | | |
|---|---|---|---|
| 1107422 | 12/1955 | France | 403/107 |
| 8902067 | 5/1988 | United Kingdom . | |

*Primary Examiner*—Jose V. Chen
*Attorney, Agent, or Firm*—Kilpatrick & Cody

[57] ABSTRACT

A shelving system having four shelf posts, a plurality of rectangular shelves, each of which has a hollow, tapered, tubular collar mounted on each corner, and a plurality of shelf supports, each having two halves joined along a continuous hinge, a substantially tubular interior surface having at least one ridge thereon to be received in a groove in the shelf posts, an exterior surface having spaced, vertical ribs and which is generally conical for mating with the inside of the tapered, tubular collar, and a two-part snap latch for locking the support around a shelf post.

9 Claims, 3 Drawing Sheets

ADJUSTABLE SHELVING

BACKGROUND OF THE INVENTION

The present invention relates to post type shelving that use shelf supports that have two halves hinged to close around a post with a snap lock or closure. Shelving systems using round or square corner posts and welded wire shelves have been long known. These systems typically use corner posts with a series of spaced annular grooves or, alternatively, notches cut into the posts. Tapered shelf supports having interior ridges corresponding to the annular grooves or notches are then placed around the post and locked or held in place. A welded wire shelf having tubular tapered collars at each corner is threaded over the posts and allowed to rest on the shelf supports as they slide into the collars. Because of the tapered shape of the support and the collar and the nesting of the shelf support ridge in the post groove, the support is tightened around the post and collar rests on and is supported by the shelf supports.

In the past, various shelf support designs have been used. For example, U.S. Pat. Nos. 3,640,498, 3,675,598, 4,138,953, 4,527,490, 4,627,543, 4,656,952, 4,754,712, 4,799,818, 4,852,501, and International application No. PCT/US89/02067 all disclose shelf supports of the same general type as described above. However, none of these shelf supports have been entirely satisfactory. The Bolinger shelf support disclosed in PCT/US89/02067 is hinged, has a snap closure, and contains one or two internal ridges. However, the Bolinger shelf support has smooth exterior sides, which provides often unsatisfactory contact between the collar and the shelf support and does not allow the collar to grip the shelf support tightly. In addition, the Bolinger shelf support has a beveled or chamfered upper lip which permits the collar to disengage by moving vertically when the shelf assembly is jarred or bumped. This often occurs when the shelving in used inside of a truck or a delivery van. Furthermore, the Bolinger shelf support can be snapped in place around the post without the ridges being in alignment with the grooves in the posts, thereby increasing the possibility that a corner of the shelf will be misaligned with the other corners of the shelf. Finally, the grooves of the Bolinger posts are rounded rather than square. Rounded groove do not satisfactorily resist the slippage of the shelf support ridges, thereby reducing the load capacity of the shelf support.

SUMMARY OF THE INVENTION

The exterior of the shelf support of the present invention has vertical ribs and a rounded, protruding upper lip. The ribs allow for more positive, controlled contact between the shelf support and the collar, thereby allowing the collar to compress the shelf support more tightly and uniformly around the post. The protruding lip is rounded on its upper side and undercut on its lower side, thereby allowing the collar to slide over the shelf support easily while resisting the tendency of the collar to ride up or jump off the shelf support.

The inside of the shelf support of the present invention has two ridges which are rounded on their upper sides, square on the lower side, and match spaced annular grooves cut into the posts. The square lower side resists slippage out of the post groove and increases the load capacity of the shelf support. The interior diameter of the closed shelf support is such that the shelf support cannot be latched around the posts unless the ridges are mated within the grooves of the posts, thereby reducing the chances of incorrect positioning on a post.

Accordingly, one of the objectives of the present invention is to provide adjustable shelving with a shelf support that increases the load capacity of the shelf.

Another objective of the present invention is to provide adjustable shelving that can be easily and quickly assembled.

Still another objective of the present invention is to provide adjustable shelving with a support that prevents the shelf from dislodging when the shelf is bumped or jarred.

A further objective of the present invention is to provide adjustable shelving with a shelf support that is easy to align.

Still another objective of the present invention is to provide adjustable shelving with a shelf support that is inexpensive.

These and other objectives and advantages of the present invention will be obvious from the description and claims that follow.

DETAILED DESCRIPTION OF THE DRAWINGS

Figure 1:
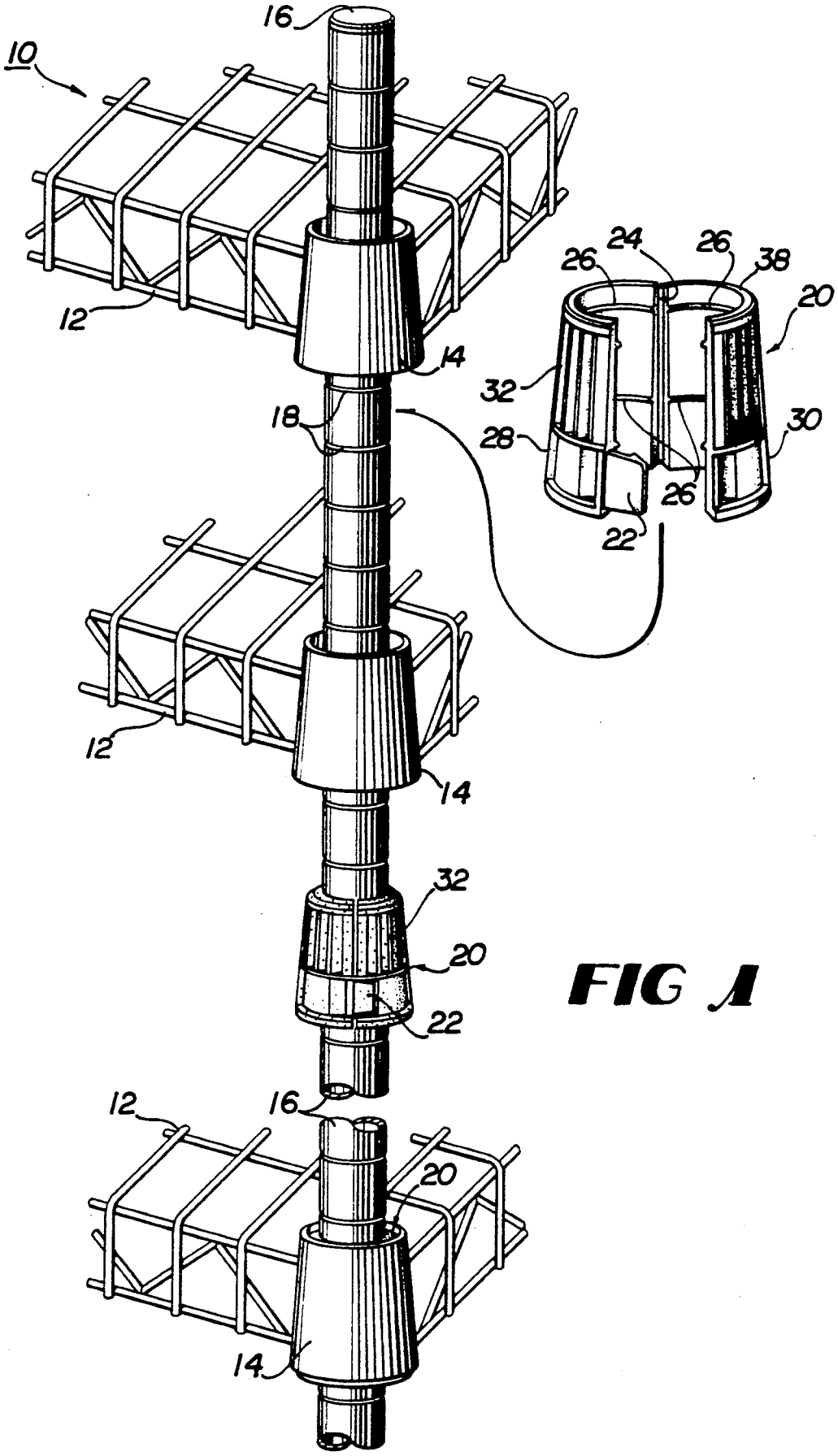
FIG. 1 is a perspective view of the shelving of the present invention with one shelf support 20 shown locked onto a post and another shelf support shown off the post and open.

As can be seen in FIG. 1, the adjustable shelving system 10 of the present invention consists of a shelf 12 which is preferably made of welded steel, stainless steel, or aluminum wire but may be of alternative design and materials, including sheet metal or plastic. A collar 14 is attached, by welding or otherwise, at each corner of shelf 12. Collar 14 is preferably made of steel, stainless steel, or aluminum but other suitable materials may also be used. Collar 14 is a tapered tube with a vertical tubular axis and the smaller diameter end 36 up.

Figure 3:
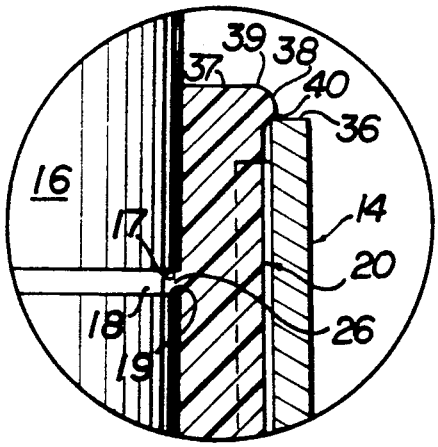
FIG. 3 is an enlarged detail view taken at circle 3 in FIG. 2 of a groove-containing portion of the post and, in section, a ridge-bearing portion of the support.
Figure 2:
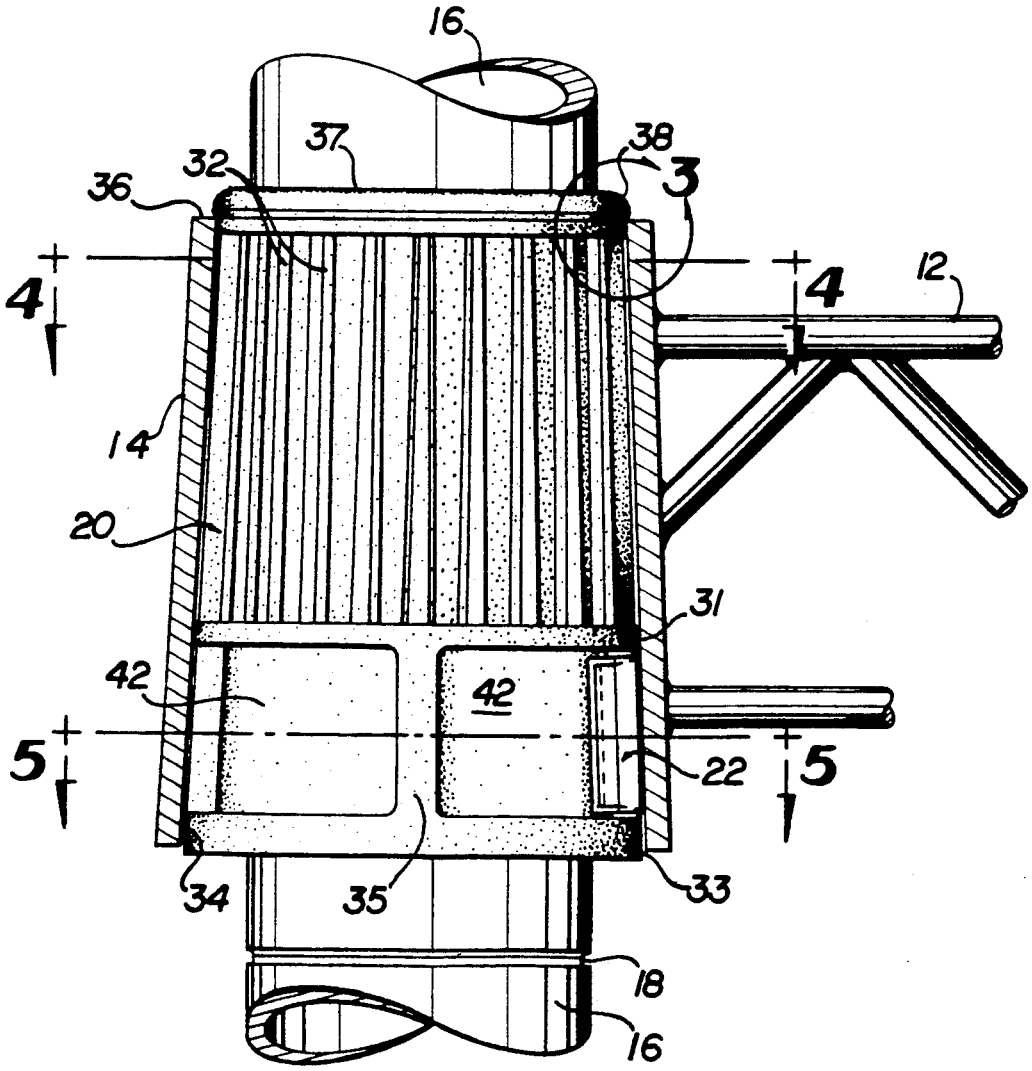
FIG. 2 is an enlarged side elevation view of a portion of the post and one corner of a shelf of the system shown in FIG. 1 with the collar 14 shown in section to make the support 20 visible.

Four posts 16, which are typically hollow and preferably made of steel, stainless steel, or aluminum, are positioned vertically at the four corners of shelf 10. As can be seen in FIGS. 1, 2, and 3, each post 16 contains multiple grooves 18 which are rounded or cove-shaped at the top 17 and flat and square on the bottom 19. In other words, groove 18 has the profile of typical shoe molding used in residential house construction at the intersection of the floor and baseboard. Once posts 16 are properly positioned, shelf supports 20 can be placed on posts 16 at the desired height of shelf 12.

Shelf support 20, preferably made of injection molded thermoplastic, has two halves 28 and 30 connected along a continuous hinge 24 to form, when closed, a hollow, truncated cone that fits around a post 16 and is received within a collar 14. The free ends of halves 28 and 30 are connected by snap latch 22. Latch 22 includes a tongue 23 with an inner ramp surface 25 (see FIG. 5). Inner ramp surface 25 causes tongue 23 to ride up over catch 27 when the latch is closing until the edge 29 of catch 27 is reached and tongue 23 falls into its catched position. The interior of shelf support 20 is smooth and contains two parallel ridges 26, which are of similar cross section and match the spacing of grooves 18 in order to mate with those grooves. The exterior of shelf support 20 contains regularly spaced vertical ribs 32 along its entire perimeter that extend from the lip 38 approximately two-thirds of the way down support 20. Annular rings 31 and 33 and four short vertical ribs 35 therebetween define four depressions 42 occupying the lower one-third of support 20.

The upper end 37 of support 20 carries an outwardly protruding lip 38 which has an arcuate upper profile 39 and an undercut lower profile 40 to facilitate holding shelf collars 14 in place as explained below.

In use, shelf support 20 is located along post 16 at the desired height of shelf 12 with ridges 26 aligned with grooves 18. Halves 28 and 30 are then rotated about hinge 24 so that shelf support 20 clasps post 16. As halves 28 and 30 are rotated about hinge 24, ridges 26 nest within grooves 18 and latch 22 engages, locking shelf support 20 in place around post 16. It should be noted that the interior diameter of shelf support 20 should be small enough that latch 22 will not engage unless ridges 26 nest within grooves 18 in post 16.

Figure 4:
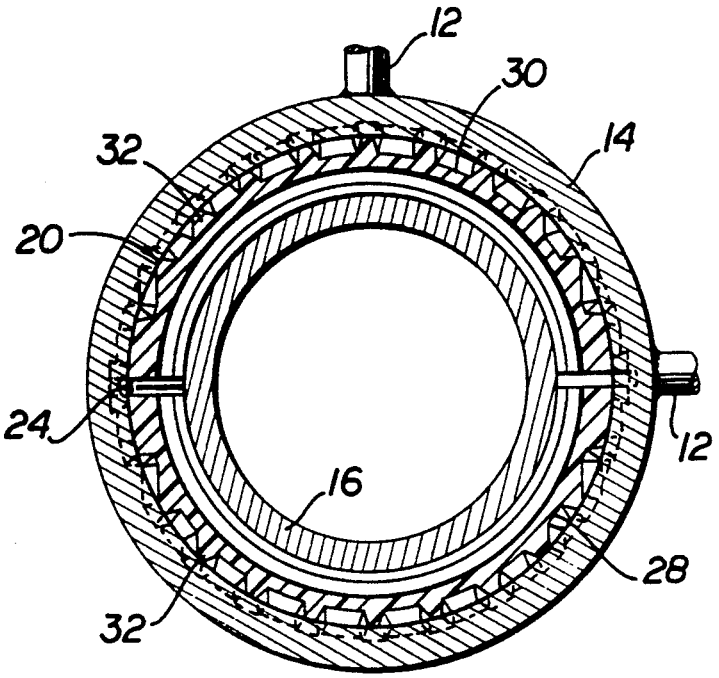
FIG. 4 is a cross section view taken along line 4—4 of FIG. 2.
Figure 5:
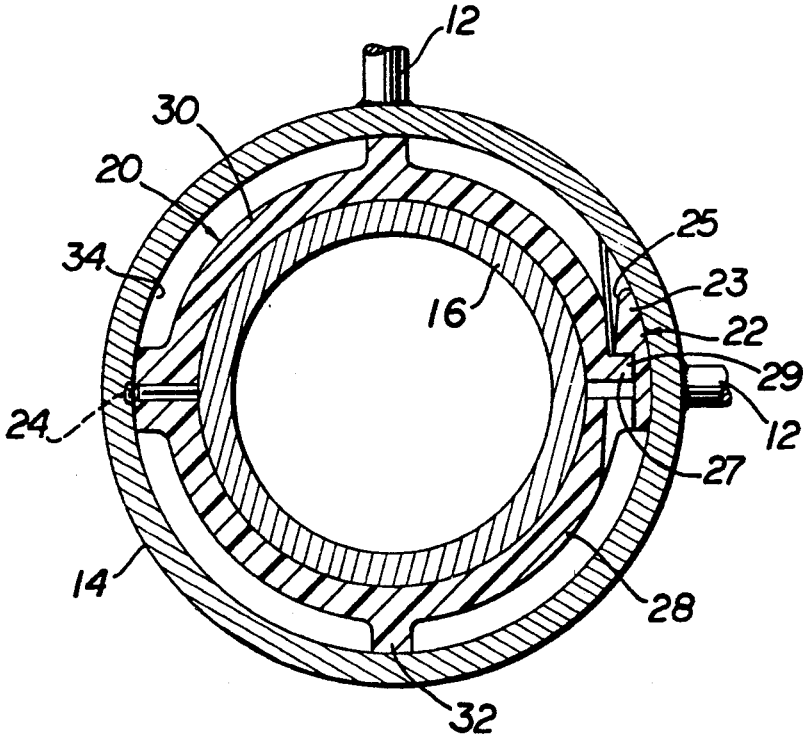
FIG. 5 is a cross section view taken along line 5—5 of FIG. 2.

Once shelf support 20 is properly located, collar 14 contained on shelf 12 is lowered around post 16 until it envelops shelf support 20. As can be seen in FIGS. 4 and 5, interior face 34 of collar 14 bears on ribs 32, compressing shelf support 20 around post 16. As upper edge 36 of collar 14 slides below lip 38, undercut 40 engages edge 36 and resists upward movement of collar 14. As is further shown in FIG. 2, lip 38 also seals the space between post 16 and collar 14, thereby preventing foreign matter from accumulating there.

This description is provided for illustration and explanation. It will be apparent to those skilled in the relevant art that modifications and changes may be made to the invention as described above without departing from its scope and spirit.

I claim:

1. A shelf support for supporting on a round shelf post a hollow, tapered, tubular collar mounted on a shelf, comprising:

a) two support halves joined along a continuous hinge permitting the halves to pivot apart at least as wide as their closed diameter and to pivot closed to form i) a substantially tubular interior surface having at least one annular ridge thereon having a profile that is arcuate on its upper side and square to the interior surface of the support on its lower side to be received in an annular groove in the shelf post and ii) an external surface having space, vertical ribs and which is generally conical for mating with the inside of the tapered, tubular collar, and b) a two-part snap latch, one part of which is attached to each half for locking the halves closed around a shelf post.

2. The support of claim 1 further comprising an annular lip on the smaller diameter end of the support external surface for resisting slippage between the collar and the support.

3. The support of claim 1 wherein the ribs extend only approximately two-thirds of the length of the support.

4. A shelving system, comprising:

a) four shelf posts;

b) a plurality of rectangular shelves, each of which has a hollow, tapered, tubular collar on each corner; and c) a plurality of shelf support, each comprising:

i) two support halves joined along a continuous hinge permitting the halves to pivot apart at least as wide as their closed diameter and to pivot closed to form 1) a substantially tubular interior surface having at least one annular ridge thereon having a profile that is arcuate on its upper side and square to the interior surface of the support on its lower side to be received in an annular groove in the shelf posts and 2) an external surface having spaced, vertical ribs and which is generally conical for mating with the inside of the tapered, tubular collar, and ii) a two-part snap latch, one part of which is attached to each half for locking the halves closed around a shelf post.

5. The support of claim 4 wherein the ribs extend only approximately two-thirds of the length of the support.

6. A shelf support for supporting on a round shelf post a hollow, tapered, tubular collar mounted on a shelf, comprising:

a) two support halves joined along a continuous hinge permitting the halves to pivot apart at least as wide as their closed diameter and to pivot closed to form i) a substantially tubular interior surface having at least one ridge thereon to be received in a groove in the shelf post and ii) an external surface that is generally conical for mating with the inside of the tapered, tubular collar and having an upper portion and a lower portion, the upper portion extending approximately two-thirds of the length of the support and containing spaced, vertical ribs along the entire length of the upper portion and b) a two-part snap latch contained in the lower portion, one part of which is attached to each half for locking the halves closed around a shelf post.

7. The support of claim 6 wherein the ridge is annular and has a profile that is arcuate on the upper side and square to the interior surface of the support on the lower side.

8. A shelving system, comprising:

a) four shelf posts;

b) a plurality of rectangular shelves, each of which has a hollow, tapered, tubular collar on each corner; and c) a plurality of shelf supports, each comprising:

i) two support halves joined along a continuous hinge permitting the halves to pivot apart at least as wide as their closed diameter and to pivot closed to form 1) a substantially tubular interior surface having at least one ridge thereon to be received in a groove in the shelf posts and 2) an external surface that is generally conical for mating with the inside of the tapered, tubular collar and having an upper portion and a lower portion, the upper portion extending approximately two-thirds of the length of the support and containing spaced, vertical ribs and ii) a two-part snap latch contained in the lower portion, one part of which is attached to each half for locking the halves closed around a shelf post.

9. The support of claim 8 wherein the ridge is annular and has a profile that is arcuate on the upper side and square to the interior surface of the support on the lower side.

* * * * *